US007083055B1

(12) United States Patent
Ambrosat

(10) Patent No.: US 7,083,055 B1
(45) Date of Patent: Aug. 1, 2006

(54) HOCKEY EQUIPMENT DRYING RACK

(76) Inventor: Harry Ambrosat Ambrosat, 8516 Creekside La., Darien, IL (US) 60561

( * ) Notice: Subject to any disclaimer, the term of this patent is extended or adjusted under 35 U.S.C. 154(b) by 0 days.

(21) Appl. No.: 11/168,197

(22) Filed: Jun. 28, 2005

(51) Int. Cl.
*A47F 7/00* (2006.01)

(52) U.S. Cl. ..... 211/85.7; 211/38; 248/165

(58) Field of Classification Search ..... 211/1, 211/2, 13.1, 85.3, 85.8, 30, 33, 34, 37, 38, 211/60.1, 123, 124, 163, 167, 168, 169, 171, 211/170, 175, 208, 85.7, 13, 182, 189, 193, 211/196, 205, 195; 248/163.1, 165; 280/814, 280/47.131; 206/315.1, 292, 287.1, 286, 206/287, 289, 299; 312/5, 6; 294/143; 403/119, 403/164

See application file for complete search history.

(56) References Cited

U.S. PATENT DOCUMENTS

D284,415 S * 6/1986 Cahoon ..... D34/17
4,627,544 A * 12/1986 Scarpa et al. ..... 211/189
4,729,394 A * 3/1988 Timmes et al. ..... 134/199
5,377,849 A * 1/1995 Martin ..... 211/85.7
5,503,312 A * 4/1996 Kassner ..... 223/120
5,520,293 A * 5/1996 Hartley ..... 211/182
5,685,440 A * 11/1997 Mason ..... 211/189
D398,469 S * 9/1998 Leong et al. ..... D6/552
5,906,277 A * 5/1999 Vienneau ..... 206/315.1
6,010,044 A * 1/2000 Hsiao ..... 223/85
6,073,783 A * 6/2000 Allman ..... 211/85.3
6,138,841 A * 10/2000 Klein et al. ..... 211/85.7
6,263,591 B1 * 7/2001 La Porte ..... 34/622
6,591,994 B1 * 7/2003 Bearss ..... 211/85.7
D487,831 S * 3/2004 Savoie ..... D32/58

* cited by examiner

*Primary Examiner*—Richard E. Chilcot, Jr.
*Assistant Examiner*—Lindsay M. Maguire
(74) *Attorney, Agent, or Firm*—Allan J. Franowsky

(57) ABSTRACT

A hockey equipment drying rack that is placed in a hockey equipment carrying bag and remains in the carrying bag while functioning as a drying rack. The base of the drying rack is rectangular in shape and fits snugly against the walls of the bag, the base having arms that rotate up and out of the top of the bag. Holding devices are attached to the arms for holding wet hockey equipment in a spaced out fashion for drying. After drying, the hockey equipment remains on the holding devices as the arms cooperate to fold down into the bag for transporting.

5 Claims, 2 Drawing Sheets

HOCKEY EQUIPMENT DRYING RACK

BACKGROUND OF THE INVENTION

1. Field of the Invention

This invention generally pertains to hockey equipment drying racks. Specifically, this invention pertains to a drying rack that remains in and is integral with a hockey equipment bag. The drying rack structure includes a plurality of rotatable arms that various items of hockey equipment are attached to. These arms rotate to collapse cooperatively in a closed hockey equipment bag. Upon opening of the hockey equipment bag, the arms with all the associated hockey equipment can be rotated to an essentially vertical position, thereby placing all of the equipment in the open air for drying.

2. Description of the Prior Art

It is well known that hockey equipment becomes wet with perspiration and ice during a hockey game. Hockey equipment includes gloves, a helmet, shoulder pads, elbow pads, skates, shin guards and other clothing. Football and other sports equipment are also subject to becoming wet for similar reasons in addition to the possibility of rain during a game. Hockey games are played frequently every day or every other day with practices in between. This allows only a short time to dry the equipment between uses and between those times when the equipment is to be washed. Whether at home or at a motel when games are scheduled away from home, hockey equipment can be strewn on the floor, or over a chair, table or bed and left to dry in a haphazard manner, with layers and folds in the clothing further complicating the drying process. If the hockey equipment is not dried thoroughly after becoming wet, the possibility of mold and mildew forming on the equipment increases with time. Unpleasant odors would also accompany this condition.

An efficient way to dry hockey equipment is to use a drying rack which spreads the equipment out into the open air for the fastest drying times. Several drying racks are available for the purpose of drying hockey equipment, but they require that the equipment be removed from the equipment bag and hung on the drying rack. After drying, the equipment is returned to the equipment bag creating the possibility that an item can be misplaced or lost during those two transfers. The available drying racks often do not provide enough space between equipment items to provide sufficient air circulation from all sides of each piece to maximize drying efficiency. Also, items that eventually have to be laundered are removed from the bag possibly leaving the rest of the equipment in the bag in its wet state. The possibility of mold and mildew, along with the accompanying odors, could grow on the rest of the equipment. In addition, the bag itself could require cleaning.

U.S. Pat. No. 6,591,994 to Bearss discloses a hockey equipment drying rack consisting of two intersecting panels. Equipment must be removed from the equipment bag and hung on apertures on the panels. The panels would inhibit the airflow, thereby slowing down drying times. Equipment could be misplaced during the transfer from the equipment bag to the drying rack and back again. U.S. Pat. No. 6,263,591 to La Porte discloses an equipment drying container with heating elements and drying fans to dry sports equipment. It is not a drying rack, but instead a heated forced air dryer. U.S. Pat. No. 6,138,841 to Klein, et al. discloses a storage rack for sports equipment, not an equipment drying rack. That storage rack is designed to hang on a door or a wall which would provide poor air circulation if one were to try to use this rack as a drying rack. U.S. Pat. No. 6,073,783 to Allman discloses a free standing athletic equipment drying rack. Equipment must be removed from the equipment bag to be placed on the drying rack and returned to the equipment bag after drying possibly causing misplaced equipment. U.S. Pat. No. 5,906,277 to Vienneau discloses a sports gear bag for storing sports gear. Although this bag includes a plurality of apertures to permit air circulation, the drying efficiency is greatly reduced because the sports gear is still housed inside the bag and the lack of a more spread out method of storage encourages folds and layers in the sports gear further limiting drying capability. U.S. Pat. No. 5,377,849 to Martin discloses a free standing sports equipment rack that requires that the equipment be removed from the equipment bag to be dried. It is possible to misplace equipment when removed and returned to the equipment bag.

Accordingly, the need exists for an equipment drying rack integral with the hockey equipment bag itself, capable of exposing all of the hockey gear to open air for drying. In this way, no hockey equipment would have to be removed from and replaced to the bag for drying. Further, any equipment removed from any of the arms of the rack would be immediately obvious thereby providing the additional advantage of inventory control over the hockey equipment. The arms of this drying rack can be modified for football or other sports equipment.

SUMMARY OF THE INVENTION

An object of the present invention is to provide convenience in that no drying rack has to be assembled or placed into position for use. Time and effort are reduced because the equipment bag does not have to be emptied to dry the equipment and then refilled to transport the equipment later.

Another object of the present invention is that it provides instant inventory control of the equipment. Extending the arms to an essentially vertical position instantly reveals any missing item because of its absence on the arm that the item is normally attached to.

A further object of the present invention is that homes and motels tend to have less clutter because external drying racks are not required to be standing on the floor.

A further object of the present invention is that commingling of equipment belonging to different hockey players is greatly reduced because all of the equipment remains in each individual players bag.

Still further, an object of the present invention is the arrangement whereby all of the equipment is spread out with plenty of room for the drying of each item thereby reducing the likelihood that folds and layers of clothing could develop which would effect the efficiency of the drying.

The present invention consists of a base frame, rectangular in shape, having a size that is essentially the same as the perimeter of the bottom of a hockey equipment carrying bag. The size must be large enough to create a snug fit between the base frame and the sides of the bag when the frame rests against the bottom of the bag. The base frame can be constructed out of tubing made from a non-rusting, non-corrosive material. A number of arms are pivotally attached to the base frame to allow those arms to rotate up into an essentially vertical position, receiving resting support against the sides of the bag. Some of these arms have a t-shaped piece attached to them for holding the appropriate hockey equipment for drying. Other arms may have hooks or other means for holding hockey equipment for drying.

When the drying is completed, the arms can be rotated down toward the base frame with all of the hockey equipment still attached to the arms. The present invention eliminates the need to remove the equipment from the bag for drying and then subsequently replacing the equipment in the bag for transporting. This feature greatly reduces the possibility of losing equipment and helps to reduce clutter at home or at a motel. This invention also provides a convenient method of inventory control. Any item missing from the arms will be clearly evident. All of these features together provide a great convenience in transporting and drying hockey equipment.

DETAILED DESCRIPTION OF THE INVENTION

Figure 1:
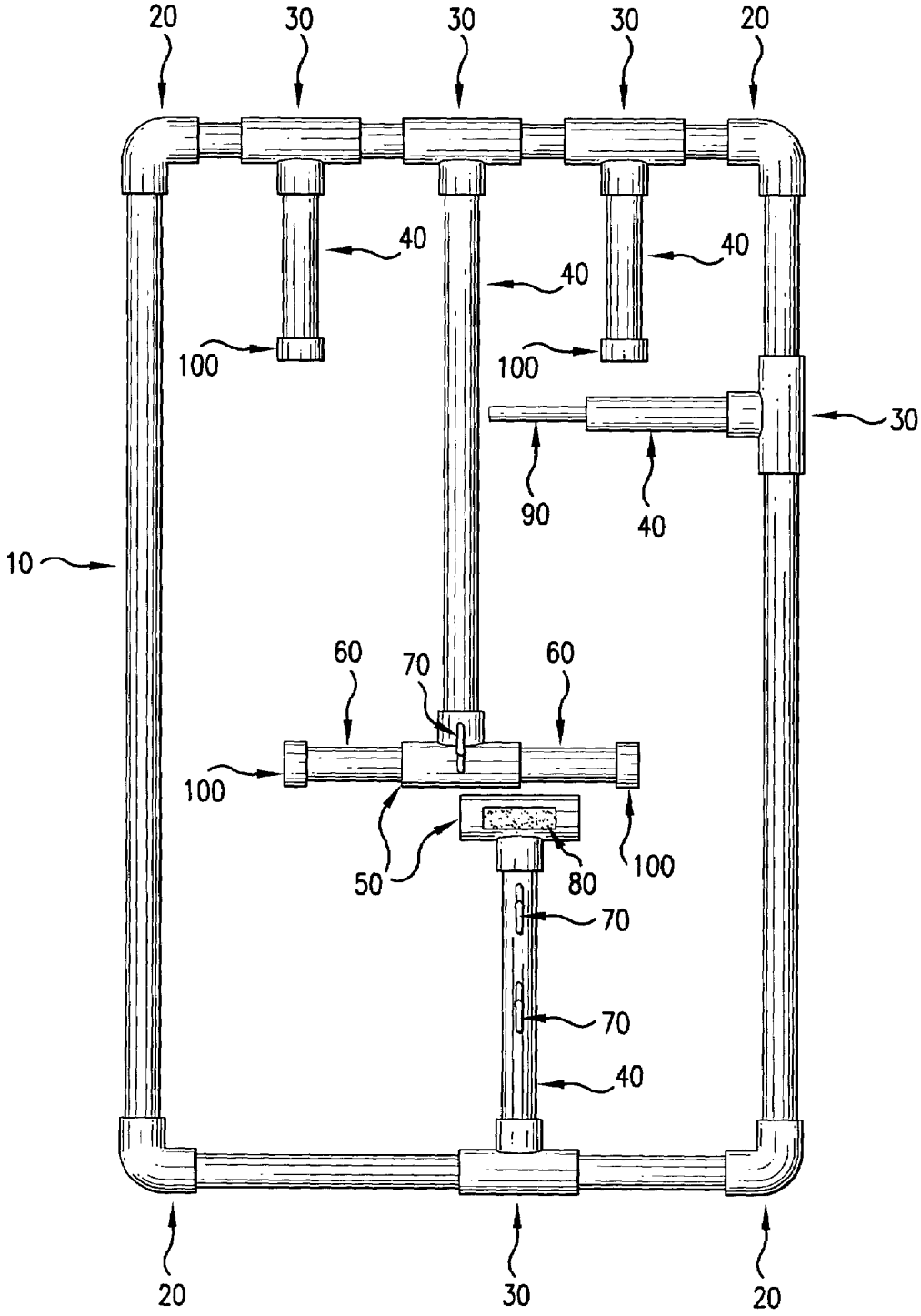
FIG. 1 is a view looking down at the collapsed or closed position of the drying rack.
Figure 2:
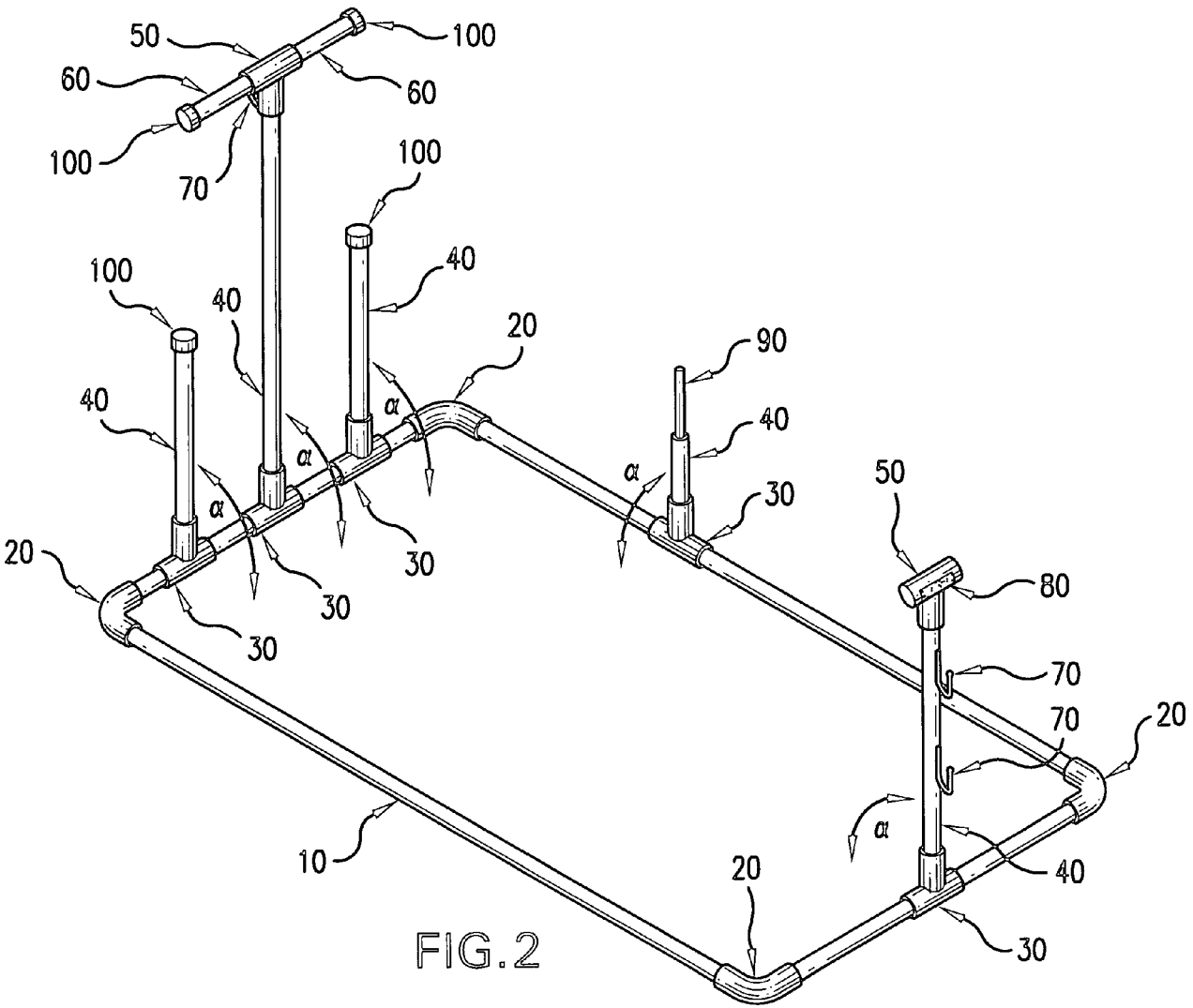
FIG. 2 is an oblique view demonstrating the arms in the open position.

The current invention has a rectangular base 10 made out of straight tubular material joined with corner attachments 20 in the preferred embodiment. This tubular material may have any cross section, but for ease of construction, the preferred embodiment has tubular material with a circular cross section. A circular cross section conveniently lends itself to function as an axle for rotatable t-pieces 30. The inside diameter of the rotatable t-pieces 30 at the point of rotation out of the plane of the rectangular base is larger than the outside diameter of the straight tubular material of base 10. It is larger only to the extent that a free rotation without binding occurs. Attached to each rotatable t-piece 30 is an arm 40 of appropriate length striking a balance between having a spaced out arrangement to provide optimal drying conditions, yet at the same time being of a length that allows all of the arms to rotate back into the plane of the rectangular base. The arms in the preferred embodiment are made out of straight tubular material, however, other suitable materials and shapes may be used.

The rectangular base 10 has a length and width essentially the size of the bottom of a hockey equipment bag. The length and width of the base 10 is no longer than what is required to provide a tight or a snug fit inside the side walls of the hockey equipment bag when the base 10 is parallel to and resting upon the bottom of a hockey equipment bag. The snug fit also serves to retain the rotatable pieces 30 on the straight tubular pieces of base 10.

When the top of a hockey equipment bag is in the open position, the arms 40 can be rotated up out of the plane of the base 10 and come to rest against the sides of the bag which serve to provide support for the arms as they go past a vertical position. This is the position for drying hockey equipment. Attached to some of these arms may be a t-piece 50. Some or all of the t-pieces 50 may have further straight tubular pieces 60 attached to them. The t-pieces 50 and the tubular pieces 60 are of a size necessary to reliably hang and hold some hockey or other sports equipment. The requirements for what is needed to hold hockey equipment, or any other sports equipment that is being dried, will depend entirely on what and how much equipment is being carried in the bag.

Some hockey or other sports equipment may require other methods to hang and hold the equipment for drying. In particular, hooks 70 may be required for some equipment. For other equipment, VELCRO®, a hook and loop fastener, 80 may be attached to the arms 40 or t-pieces 50. For drying a helmet, a rust and corrosion resistant rod 90 may be attached to an am 40 to receive the ear holes of the helmet for hanging. Caps 100 provide finished ends to the arms 40.

The foregoing description of a preferred embodiment of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims set forth below.

I claim:

1. A hockey equipment drying rack adapted to fit into a hockey equipment carrying bag where the drying rack is intended to function as a rack for holding hockey equipment in a spaced arrangement for optimal air drying without having to remove the drying rack from the bag, comprising:

a. a tubular base frame, rectangular in shape;

b. a plurality of tubular arms having a proximal end pivotally connected to the base frame so that the arms cooperatively rotate between a first closed position generally located in the plane of the base frame and a second upright or extended position at a generally right angle to the plane of the base frame and the arms having a free distal end;

c. a plurality of tubular t-pieces that attach to the free distal end of some of the tubular arms to hold and support some of the hockey equipment while drying; and d. a hanging means attached to some of the tubular arms and tubular t-pieces for releasably holding some of the hockey equipment while drying;

wherein the rotation to the extended position of each of the tubular arms is made independently of the other tubular arms.

2. The hockey equipment drying rack of claim 1 wherein some of the hanging means include a hook attached to the tubular arms and tubular t-pieces as needed to hang some of the hockey equipment for drying.

3. The hockey equipment drying rack of claim 1 wherein the tubular base frame, the tubular arms and the tubular t-pieces all have a circular cross section.

4. The hockey equipment drying rack of claim 1 wherein the tubular base frame, the tubular base arms and the tubular t-pieces are made of plastic.

5. The hockey equipment drying rack of claim 1 wherein the tubular arms holding the hockey equipment are capable of cooperatively rotating between an upright or extended drying position to the closed position for transport.

* * * * *